US008307743B2

(12) United States Patent
Hsu

(10) Patent No.: US 8,307,743 B2
(45) Date of Patent: Nov. 13, 2012

(54) ADJUSTABLE STRUCTURE FOR A HAND TOOL

(76) Inventor: Shao-Hsien Hsu, Taichung County (TW)

( * ) Notice: Subject to any disclaimer, the term of this patent is extended or adjusted under 35 U.S.C. 154(b) by 212 days.

(21) Appl. No.: 12/981,505

(22) Filed: Dec. 30, 2010

(65) Prior Publication Data

US 2012/0167725 A1 Jul. 5, 2012

(51) Int. Cl.
*B25B 23/16* (2006.01)
*B25G 1/04* (2006.01)
*B25B 15/02* (2006.01)

(52) U.S. Cl. ..... 81/438; 81/177.2

(58) Field of Classification Search ..... 81/63.1, 81/438, 177.2, 489; 403/104, 109.2, 109.3, 403/110

See application file for complete search history.

(56) References Cited

U.S. PATENT DOCUMENTS 1,269,413 A * 6/1918 Finnigan ..... 81/177.2
2,592,978 A * 4/1952 Trimboli ..... 81/177.1
6,862,776 B2 * 3/2005 Chen ..... 16/113.1
7,086,313 B2 * 8/2006 Cantlon ..... 81/438
7,089,828 B1 * 8/2006 Ho ..... 81/60
7,146,885 B2 * 12/2006 Hwang et al. ..... 81/177.2
7,458,296 B2 * 12/2008 Richter et al. ..... 81/438
7,467,575 B2 * 12/2008 Lai ..... 81/177.1
7,717,016 B2 * 5/2010 Lai ..... 81/177.1
2011/0079116 A1 * 4/2011 Hu ..... 81/177.2

* cited by examiner

*Primary Examiner* — David B Thomas

(57) ABSTRACT

An adjustable structure for a hand tool includes a handle, a shank connected with the handle, and an adjusting device mounted on the handle. The handle has a chamber defined therein and two protrusions extending therefrom. The shank has at least two clamping grooves annularly defined therein. The adjusting device includes a rotary element, two slidable elements and two springs. The rotary element has a through hole defined therein, such that the shank passes through the through hole. Two sliding channels are defined in the rotary element. Each sliding channel receives one slidable element and one spring. Each slidable element has a clamping surface formed thereon for engaging with the clamping groove. Each slidable element has an abutting slot defined therein and receiving the protrusion. The shank is adjustable by moving the desired clamping groove to selectively engage with the two slidable elements.

7 Claims, 7 Drawing Sheets

ADJUSTABLE STRUCTURE FOR A HAND TOOL

BACKGROUND OF THE INVENTION

1. Field of the Invention

The present invention relates to an adjustable structure for a hand tool, and more particularly to a structure being able to adjust an operating length of a shank.

2. Description of Related Art

A conventional extensible torque tool comprises a rod member having a series of longitudinally-spaced transverse grooves defined in one flat face thereof A tube member has an interior complementary with the rod member. The rod member telescopically engages with the tube sleeve and is in non-rotative relationship with the tube sleeve. The tube member has an aperture defined therein and extending therethrough. The tube member has a ledge formed thereon and located adjacent to a side of said aperture. A sleeve is disposed around the tube member in the region of the aperture. The sleeve has an opening defined therein and is longitudinally slidable on the tube member between two positions. In the first position the opening overlies the aperture and in the second position the opening overlies the ledge. A spring strip disposed axially on the exterior of the sleeve. The spring strip has a substantially W-shape bend which is intermediate the ends thereof and extending downwardly through the opening in the sleeve. A roller is engaged beneath the bend. When the sleeve is in the first position, the roller is biased by the spring strip to snap into one of the transverse grooves in the rod. When said sleeve is moved to the second position, the roller is biased to ride up upon the ledge.

The conventional extensible torque tool provides for adjusting the rod member. However, the transverse grooves which have to be formed on the flat face of the rod member are not able to apply on different types of tools. The rod member is not able to rotate relative to the tube member, which causes the inconvenient operation. Therefore, the conventional extensible torque tool is impractical.

The present invention has arisen to mitigate and/or obviate the disadvantages of the conventional extensible torque tool.

SUMMARY OF THE INVENTION

The main objective of the present invention is to provide an improved adjustable structure for a hand tool.

To achieve the objective, the adjustable structure for a hand tool includes a handle for adapting to be gripped by a user. A top of the handle has a chamber axially defined therein and two curved restricting slots defined therein. The two curved restricting slots are oppositely located around the chamber. Two protrusions extend from the top of the handle and diametrically disposed on an edge of the chamber.

A shank is movably and axially connected with the handle. The shank has a connecting end movably mounted in the chamber. The connecting end has a positioning groove annularly defined in an outer periphery thereof. A ring is buckled with the positioning groove and received in the chamber for positioning the connecting end of the shank in the chamber. The shank has a driving end located opposite to the connecting end and exposed outside the chamber. At least two clamping grooves are annularly defined in the outer periphery of the shank and located between the connecting end and the driving end.

An adjusting device is movably connected with the handle. The adjusting device comprises a rotary element, two slidable elements and two springs. The rotary element is rotatably mounted on the top of the handle. The rotary element has two pressing portions oppositely formed on an outer periphery thereof and extending therefrom for being easily operated by the user. The rotary element has a through hole centrally defined therein, such that the shank passes through the through hole to be inserted into the chamber of the handle. Two sliding channels are defined in a bottom of the rotary element and correspond to the top of the handle. The two sliding channels are diametrically located around the through hole and communicate with the through hole. Two elongated recesses are respectively defined in the two sliding channels. The rotary element has two restricting blocks formed on the bottom thereof and corresponding to the two restricting slots. The two restricting blocks are respectively and slidably received in the two restricting slots of the handle for restraining a rotation of the rotary element.

The two slidable elements are respectively and movably received in the two sliding channels of the rotary element. Each slidable element has a clamping surface formed in a lateral side thereof and correspondingly abutting against a periphery of the corresponding clamping groove for engaging with the shank. Each slidable element has a pin disposed on a lateral side and located opposite to the clamping surface. Each slidable element has an abutting slot defined in a bottom thereof for movably receiving the corresponding protrusion of the handle. A curved abutting surface is formed on an inner surface of each abutting slot for abutting against the corresponding protrusion, such that the two protrusions respectively abut against the two abutting surfaces and are slidable along the two abutting slots. Each slidable element has a projected portion formed on a top thereof and extending therefrom. The two projected portions are respectively and movably received in the two recesses of the rotary element.

The two springs are respectively and compressively received in the two sliding channels of the rotary element. One end of each spring is inserted by the corresponding pin to abut against the lateral side of the corresponding slidable element opposite to the clamping surface for providing a resilient force. The other end of the spring abuts against an inner periphery of the corresponding sliding channel.

When the user operates the pressing portions of the rotary element to rotate the rotary element, the two slidable elements which are respectively received in the two sliding channels are moved by the rotary element. Each protrusion of the handle abuts against the abutting surface of the corresponding slidable element and relatively slides along the abutting slot to force the slidable element to move away from the corresponding clamping groove for disengaging from the shank.

The two springs are respectively compressed by the two slidable elements. Therefore, the shank is axially movable relative to the handle and the length of the shank is adjustable by moving the desired clamping groove to be selectively clamped by the two slidable elements.

Further benefits and advantages of the present invention will become apparent after a careful reading of the detailed description with appropriate reference to the accompanying drawings.

DETAILED DESCRIPTION OF THE INVENTION

Figure 1:
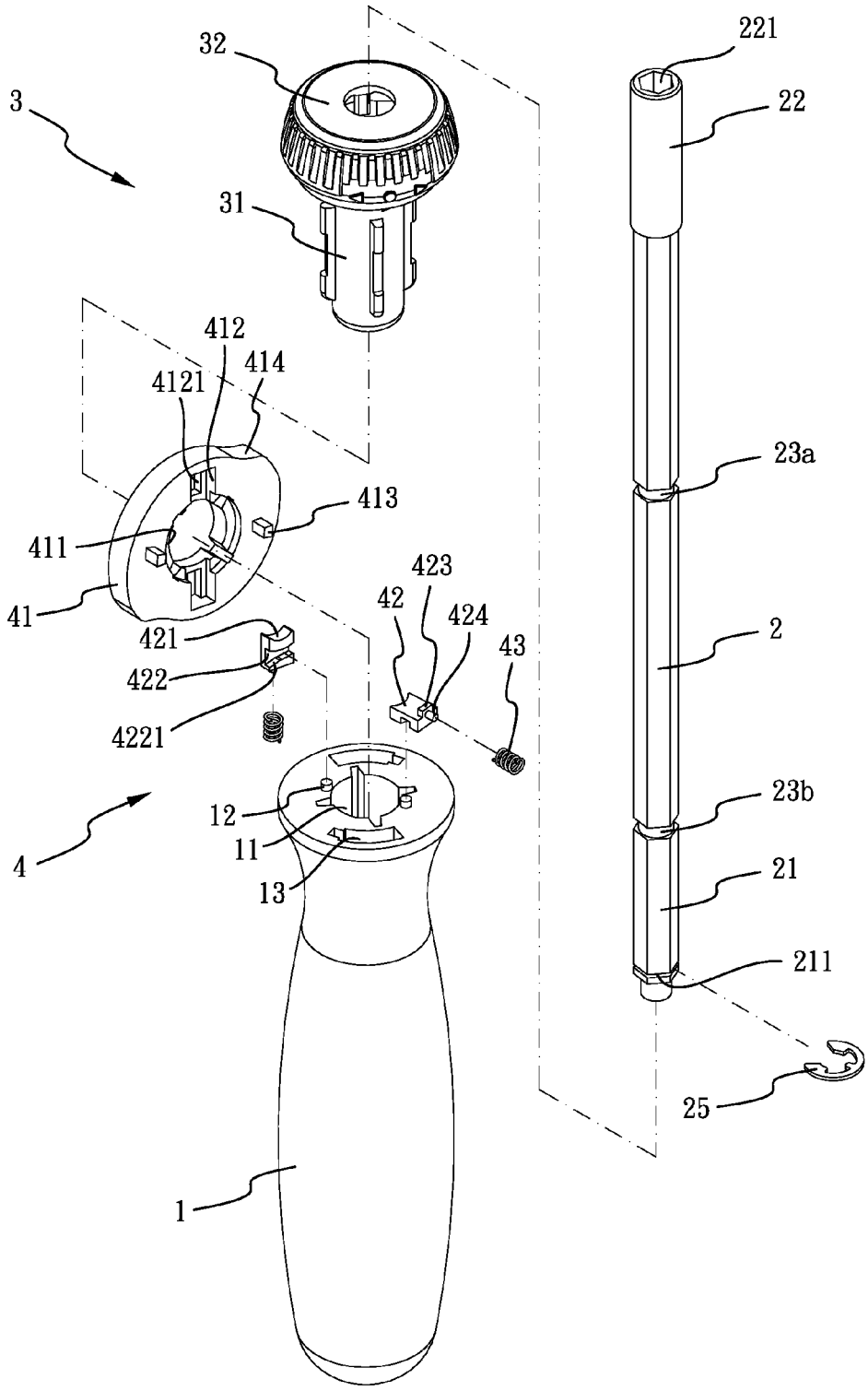
FIG. 1 is an exploded perspective view of an adjustable structure for a hand tool in accordance with the present invention.
Figure 2:
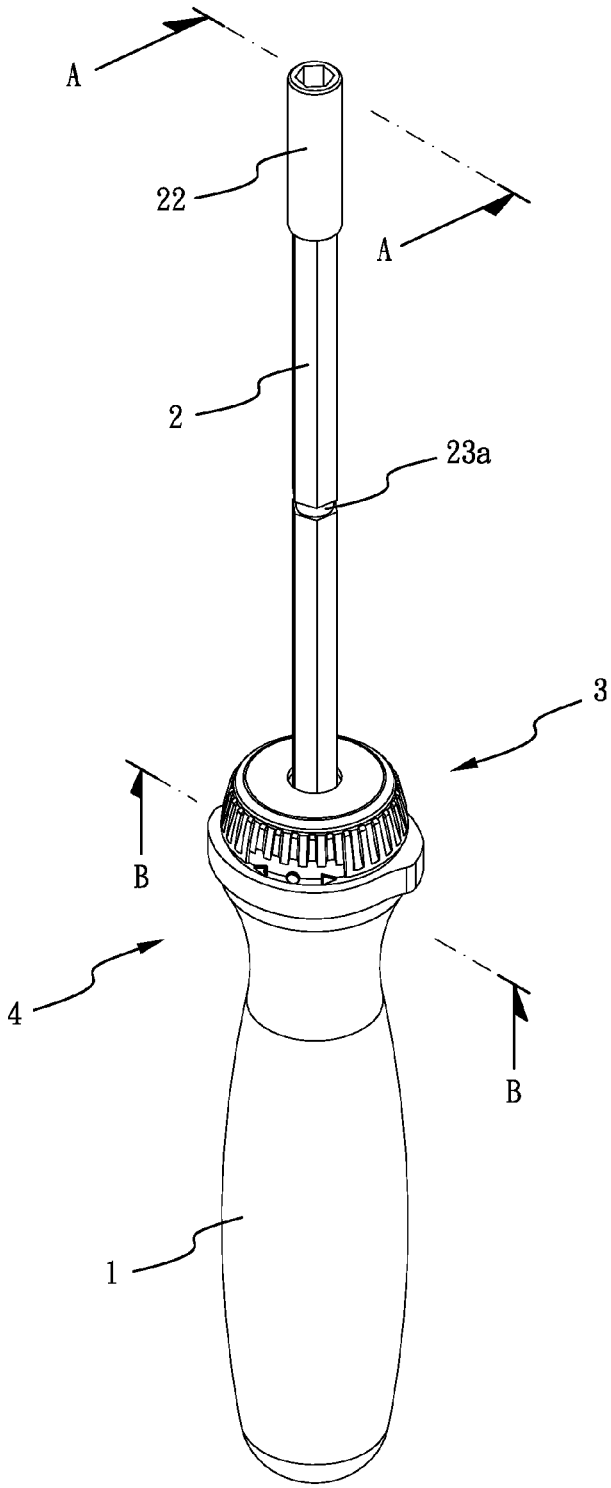
FIG. 2 is an assembled perspective view of the adjustable structure for a hand tool in accordance with the present invention.
Figure 3:
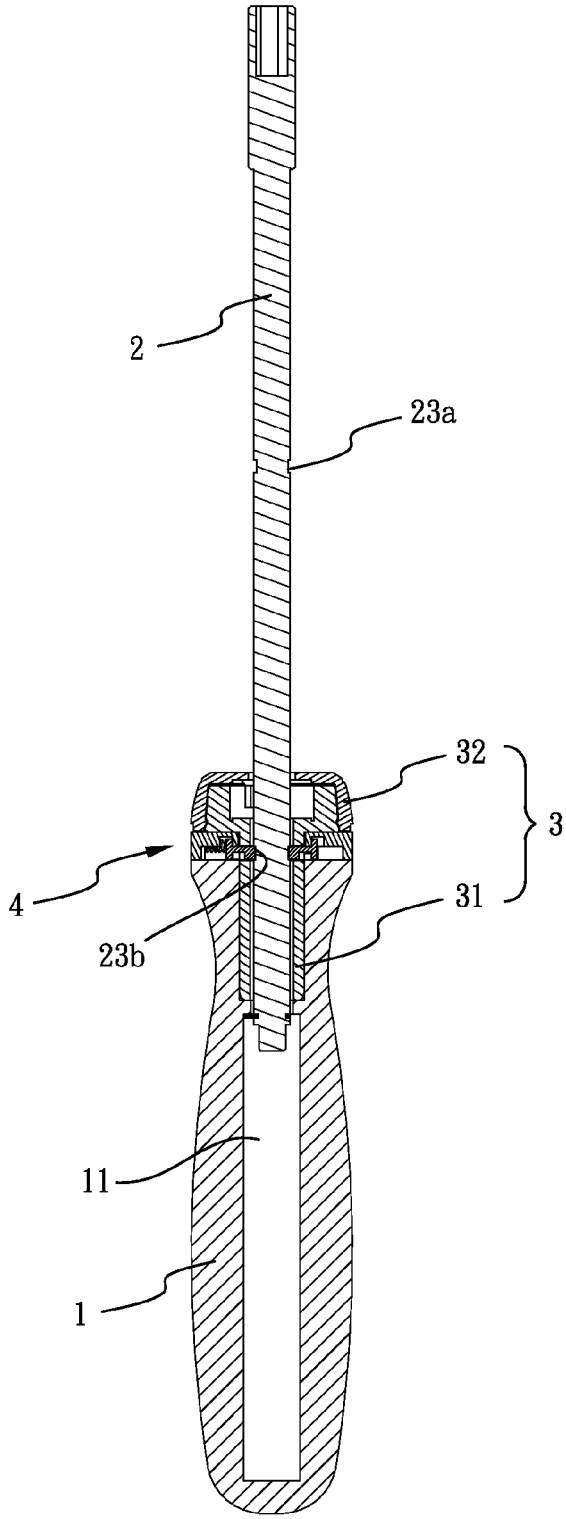
FIG. 3 is a cross-sectional plan view taken along line A-A of FIG. 2.
Figure 4:
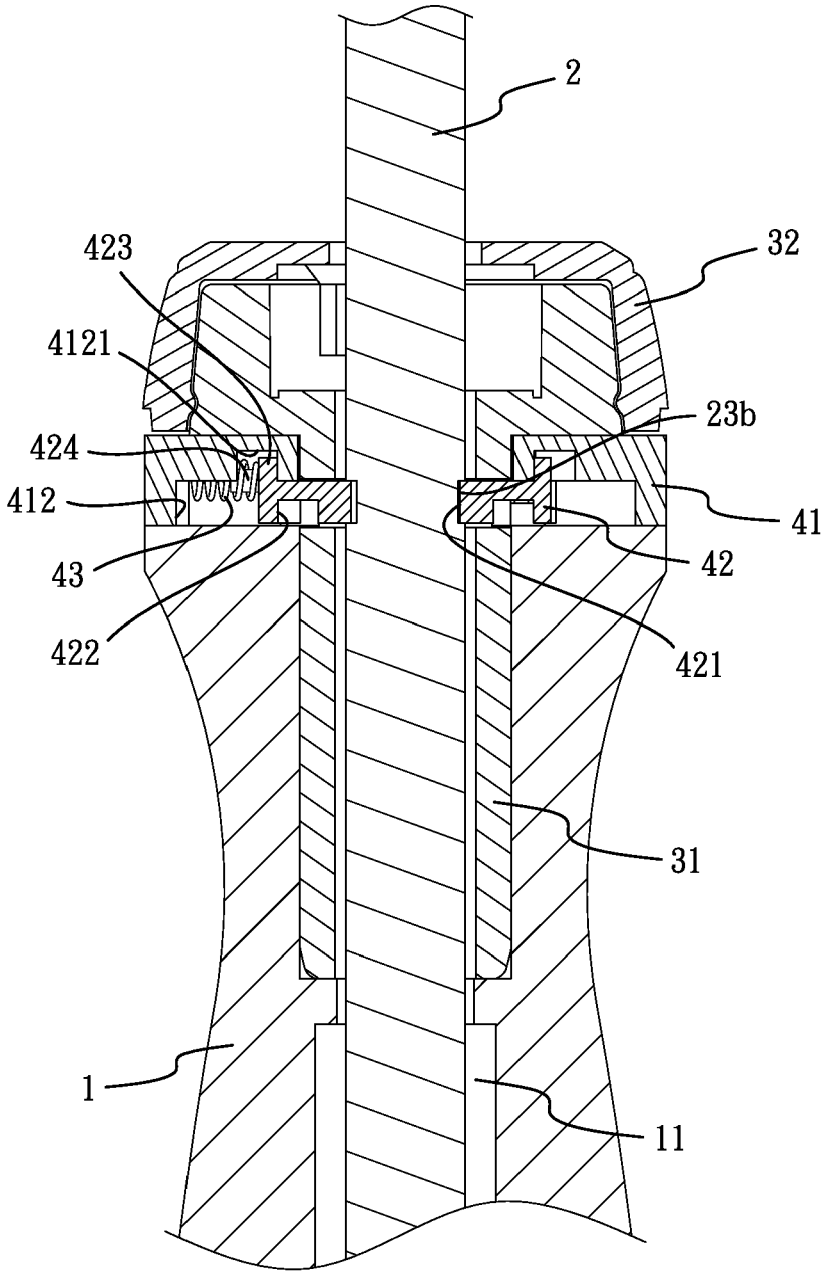
FIG. 4 is a partially enlarged plan view taken along line A-A of FIG. 2.
Figure 5:
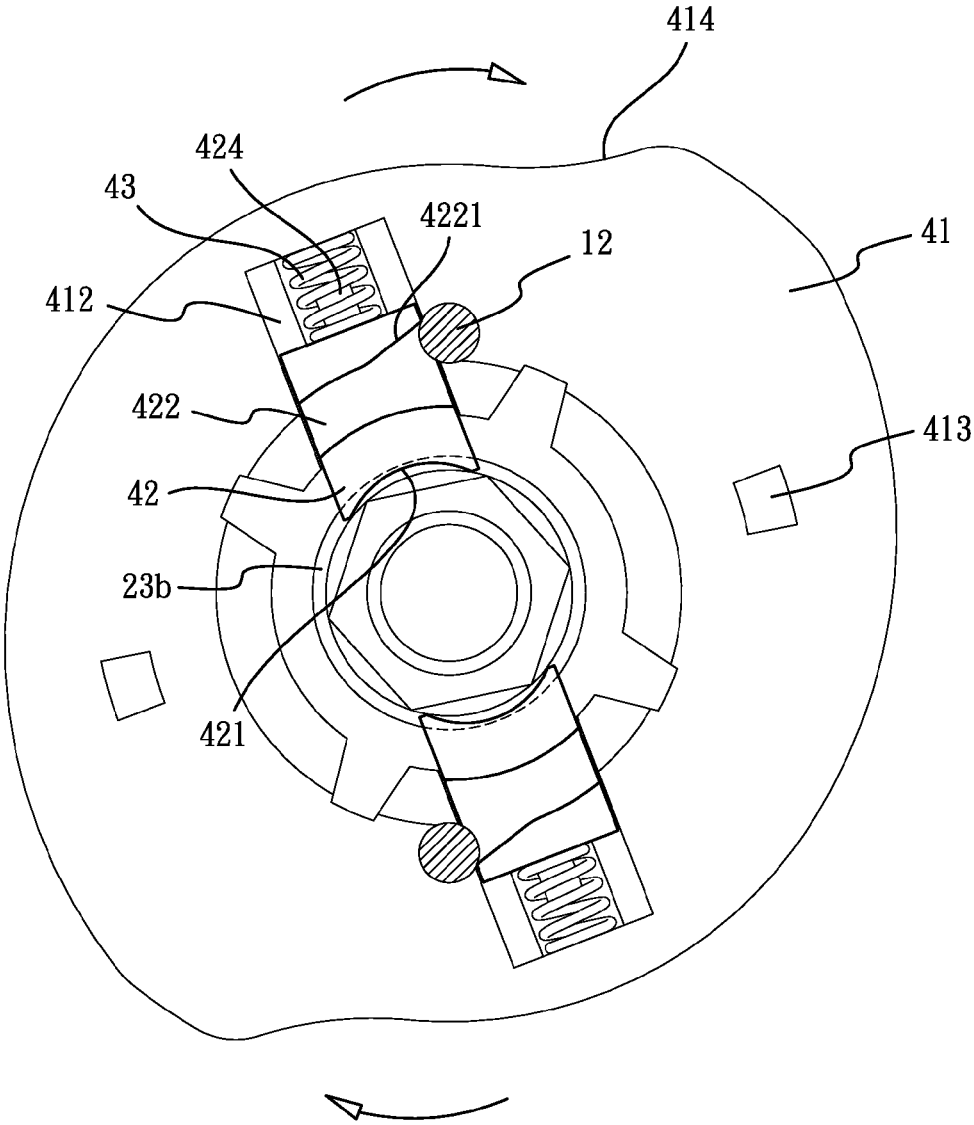
FIG. 5 is a cross-sectional plan view taken along line B-B of FIG. 2 and showing an engagement of a shank and two slidable elements.
Figure 6:
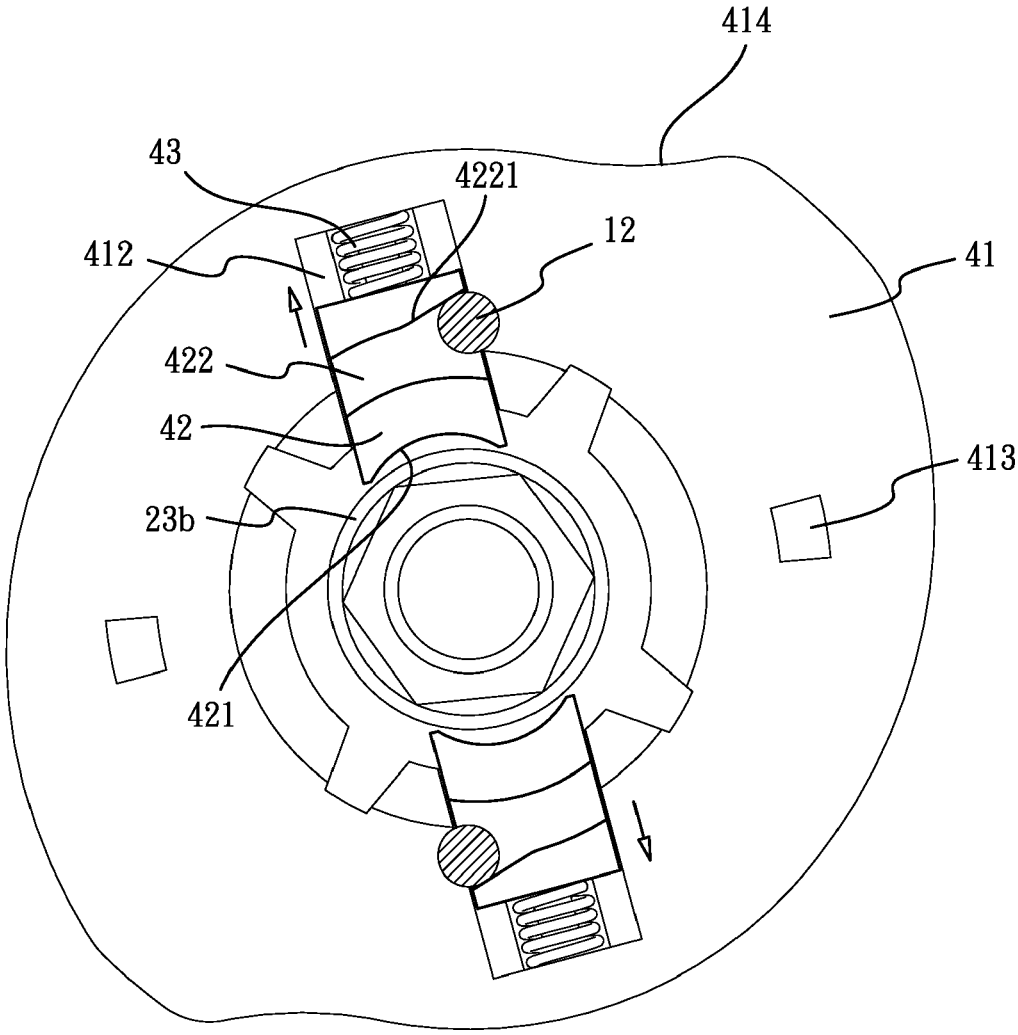
FIG. 6 is a cross-sectional plan view taken along line B-B of FIG. 2 and showing a disengagement of the shank and the two slidable elements.

Referring to the drawings and initially to FIGS. 1-4, an adjustable structure for a hand tool in accordance with a preferred embodiment of the present invention comprises a handle 1 for being gripped by a user. A top of the handle 1 has a chamber 11 axially defined therein. The chamber 11 has an inner periphery formed a stepped structure (not numbered). The top of the handle 1 has two curved restricting slots 13 defined therein. The two restricting slots 13 are diametrically located around the chamber 11. Two protrusions 12 extend from the top of the handle 1 and diametrically disposed on an edge of the chamber 11.

A shank 2 is movably and axially connected with the handle 1. The shank 2 has a connecting end 21 movably mounted in the chamber 11. The connecting end 21 has a positioning groove 211 annularly defined in an outer periphery thereof. A ring 25 is buckled with the positioning groove 211 and received in the chamber 11 for positioning the connecting end 21 of the shank 2 in the chamber 11. The shank 2 has a driving end 22 located opposite to the connecting end 21 and exposed outside the chamber 11. The driving end 22 has a retaining hole 221 defined therein for assembling with a tool bit (not shown). At least two clamping grooves are annularly defined in the outer periphery of the shank 2 and located between the connecting end 21 and the driving end 22. In the embodiment, the shank 2 has two clamping grooves 23*a*, 23*b* which are respectively disposed close to the driving end 22 and the connecting end 21.

An adjusting device 4 is movably connected with the handle 1. The adjusting device 4 comprises a rotary element 41, two slidable elements 42 and two springs 43. The rotary element 41 is rotatably mounted on the top of the handle 1. The rotary element 41 has two pressing portions 414 oppositely formed on an outer periphery thereof and extending therefrom for being easily operated by the user. The rotary element 41 has a through hole 411 centrally defined therein, such that the shank 2 passes through the through hole 411 to be inserted into the chamber 11 of the handle 1. Two sliding channels 412 are defined in a bottom of the rotary element 41 and correspond to the top of the handle 1. The two sliding channels 412 are diametrically located around the through hole 411 and communicate with the through hole 411. Two elongated recesses 4121 are respectively defined in an inner surface of the two sliding channels 412. The rotary element 41 has two restricting blocks 413 formed on the bottom thereof and corresponding to the two restricting slots 13. The two restricting blocks 413 are respectively and slidably received in the two restricting slots 13 of the handle 1 for restraining a rotation of the rotary element 41.

The two slidable elements 42 are respectively and movably received in the two sliding channels 412 of the rotary element 41. Each slidable element 42 has a clamping surface 421 formed in a lateral side thereof and correspondingly abutting against a periphery of the corresponding clamping groove 23*a*, 23*b* for engaging with the shank 2. Each slidable element 42 has a pin 424 disposed on a lateral side and located opposite to the clamping surface 421. Each slidable element 42 has an abutting slot 422 defined in a bottom thereof for movably receiving the corresponding protrusion 12 of the handle 1. A curved abutting surface 4221 is formed on an inner surface of each abutting slot 422 for abutting against the corresponding protrusion 12, such that the two protrusions 12 respectively abut against the two abutting surfaces 4221 and are relatively slidable along the two abutting slots 422. Each slidable element 42 has a projected portion 423 formed on a top thereof and extending therefrom. Each projected portion 423 has a substantially square cross section (not shown) and movably received in the corresponding recess 4121 of the rotary element 41, such that the two projected portions 423 respectively move along the two recesses 4121 for limiting a sliding distance of the two slidable elements 42.

The two springs 43 are respectively and compressively received in the two sliding channels 412 of the rotary element 41. One end of each spring 43 is inserted by the corresponding pin 424 to abut against the lateral side of the corresponding slidable element 42 opposite to the clamping surface 421 for providing a resilient force. The other end of the spring 43 abuts against an inner periphery of the corresponding sliding channel 412.

A direction-operating sleeve 3 is mounted on the top of the rotary element 41 and sleeves on the shank 2 for controlling an operating direction of the shank 2. The direction-operating sleeve 3 has a plate portion 32 formed thereon and a cylindrical portion 31 extending from a bottom of the plate portion 32. The cylindrical portion 31 passes through the through hole 411 of the rotary element 41 to be mounted in the chamber 11 of the handle 1, such that the shank 2 is able to change the operating direction by rotating the plate portion 32 in a clockwise or a anti-clockwise direction.

Figure 7:
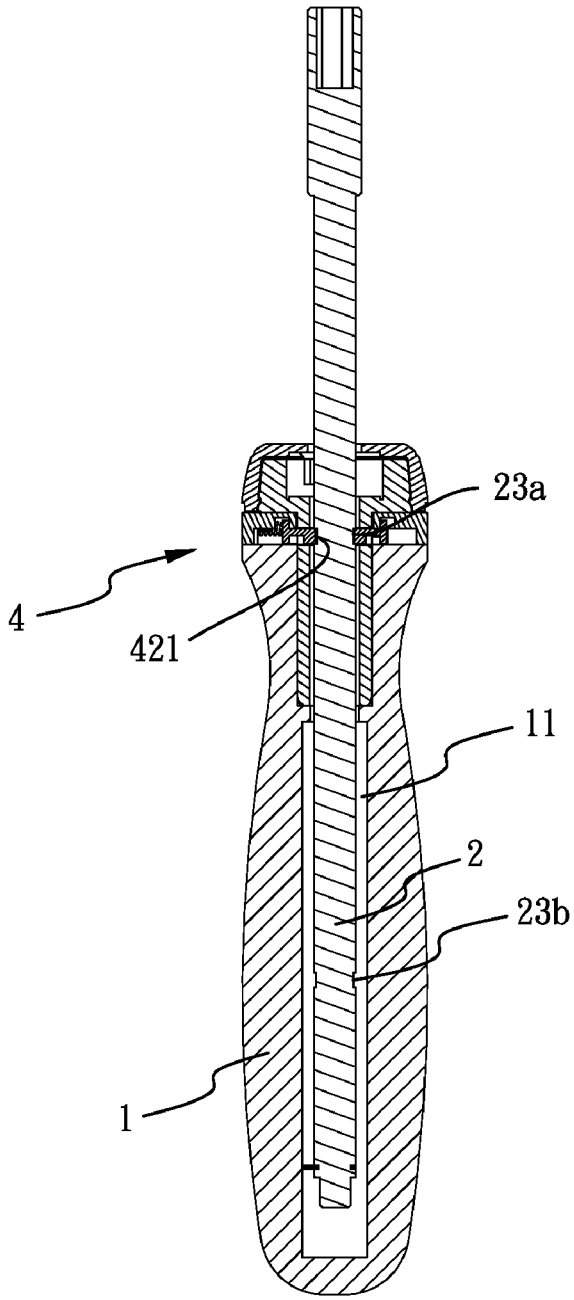
FIG. 7 is a cross-sectional plan view of the adjustable structure for a hand tool in accordance with the present invention as the shank is adjusted to have a relatively shorter operating length.

The operation of the adjustable structure for a hand tool in accordance with the present invention will be described in detailed below. As shown in FIGS. 1, 4 and 5-6, the two slidable elements 42 clamp the clamping groove 23*b* which is close to the connecting end 21. The operating length of the shank 2 is relatively longer. When the user operates the pressing portions 414 of the rotary element 41 to rotate the rotary element 41 about the shank 2, the two slidable elements 42 which are respectively received in the two sliding channels 412 are moved by the rotary element 41. Each protrusion 12 of the handle 1 abuts against the abutting surface 4221 of the corresponding slidable element 42 and relatively slides along the abutting slot 422 to force the slidable element 42 to move away from the corresponding clamping groove 23*b* for disengaging from the shank 2. The two springs 43 are respectively compressed by the two slidable elements 42. Therefore, the shank 2 is axially movable relative to the handle 1 for adjusting the operating length of the shank 2. As the clamping groove 23*a* which is close to the driving end 22 is moved to a position which corresponds to the two clamping surfaces 421 of the two slidable elements 42, the two slidable elements 42 are respectively pressed to clamp the clamping groove 23*a* which is close to the driving end 22 by the resilient force of the two springs 43, such that the operating length of the shank 2 is relatively shorter, as shown in FIG. 7.

Although the invention has been explained in relation to its preferred embodiment, it is to be understood that many other possible modifications and variations can be made without departing from the spirit and scope of the invention as hereinafter claimed.

What is claimed is:

1. An adjustable structure for a hand tool comprising:

a handle, a top of the handle having a chamber axially defined therein and two protrusions extending therefrom, the two protrusions diametrically disposed on an edge of the chamber;

a shank movably and axially connected with the handle, the shank having a connecting end movably mounted in the chamber, and a driving end located opposite to the connecting end and exposed outside the chamber, at least two clamping grooves annularly defined in an outer periphery of the shank and located between the connecting end and the driving end; and an adjusting device movably connected with the handle, the adjusting device comprising:

a rotary element rotatably mounted on the top of the handle, the rotary element having a through hole centrally defined therein, such that the shank passes through the through hole of the rotary element to be inserted into the chamber of the handle, two sliding channels defined in a bottom of the rotary element and corresponding to the top of the handle, the two sliding channels diametrically located around the through hole and communicating with the through hole;

two slidable elements respectively and movably received in the two sliding channels, each slidable element having a clamping surface formed in a lateral side thereof and correspondingly abutting against a periphery of the corresponding clamping groove for engaging with the shank, each slidable element having an abutting slot defined in a bottom thereof and movably receiving the corresponding protrusion of the handle; and two springs respectively and compressively received in the two sliding channels, one end of each spring abutting against a lateral side of the corresponding slidable element opposite to the clamping surface for providing a resilient force, the other end of the spring abutting against an inner periphery of the corresponding sliding channel;

whereby when the rotary element is rotated, the two slidable elements respectively received in the two sliding channels are moved by the rotary element, each protrusion of the handle relatively sliding along the corresponding abutting slot and forcing the slidable element to move away from the corresponding clamping groove for disengaging with the shank, the two springs respectively compressed by the two slidable elements, such that the shank is axially movable relative to the handle and the length of the shank is adjustable by moving the desired clamping groove to selectively engage with the two slidable elements.

2. The adjustable structure for a hand tool as claimed in claim 1, wherein the top of the handle has two curved restricting slots oppositely defined therein, the rotary element having two restricting blocks formed on the bottom thereof and corresponding to the two restricting slots, the two restricting blocks respectively and slidably received in the two restricting slots for restraining a rotation of the rotary element.

3. The adjustable structure for a hand tool as claimed in claim 1, wherein each slidable element has a projected portion formed on a top thereof and extending therefrom, the rotary element having two elongated recesses respectively defined in the two sliding channels for respectively and movably receiving the two projected portions of the two slidable elements.

4. The adjustable structure for a hand tool as claimed in claim 1, wherein each slidable element has a pin disposed on the lateral side and located opposite to the clamping surface for being inserted into the corresponding spring.

5. The adjustable structure for a hand tool as claimed in claim 1, wherein each slidable element has a curved abutting surface formed on an inner surface of the abutting slot for abutting against the corresponding protrusion of the handle.

6. The adjustable structure for a hand tool as claimed in claim 1, wherein the connecting end of the shank has a positioning groove annularly defined in the outer periphery thereof, a ring buckled with the positioning groove and received in the chamber for positioning the connecting end of the shank in the chamber.

7. The adjustable structure for a hand tool as claimed in claim 1, wherein the rotary element has two pressing portions oppositely formed on an outer periphery thereof and extending therefrom for being easily operated by a user.

* * * * *